US011591534B2

(12) United States Patent
Favetta et al.

(10) Patent No.: US 11,591,534 B2
(45) Date of Patent: Feb. 28, 2023

(54) PROCESS FOR PRODUCING CLEAN COAL USING CHEMICAL PRE-TREATMENT AND HIGH SHEAR REACTOR

(71) Applicant: Controlamatics Corporation, Cedar Knolls, NJ (US)

(72) Inventors: Dino Favetta, Cedar Knolls, NJ (US); Tao Chen, Jersey City, NJ (US); Robert Tinder, Federal Way, WA (US)

(73) Assignee: Controlamatics Corporation, Cedar Knolls, NJ (US)

( * ) Notice: Subject to any disclaimer, the term of this patent is extended or adjusted under 35 U.S.C. 154(b) by 0 days.

(21) Appl. No.: 17/311,169

(22) PCT Filed: Dec. 3, 2019

(86) PCT No.: PCT/US2019/064245
§ 371 (c)(1),
(2) Date: Jun. 4, 2021

(87) PCT Pub. No.: WO2020/117810
PCT Pub. Date: Jun. 11, 2020

(65) Prior Publication Data

US 2022/0033728 A1 Feb. 3, 2022

Related U.S. Application Data

(60) Provisional application No. 62/775,617, filed on Dec. 5, 2018.

(51) Int. Cl.
*C10L 9/10* (2006.01)
*C10L 9/02* (2006.01)

(52) U.S. Cl.
CPC .. *C10L 9/10* (2013.01); *C10L 9/02* (2013.01)

(58) Field of Classification Search
CPC ..... C10L 9/02; C10L 9/10
See application file for complete search history.

(56) References Cited

U.S. PATENT DOCUMENTS 4,477,259 A * 10/1984 Funk ..... C10L 1/326 44/280
2010/0317748 A1 12/2010 Hassan et al.

FOREIGN PATENT DOCUMENTS

CN 107164005 * 9/2017
EP 0057577 B1 5/1986
WO WO 2005/040435 A1 5/2005

OTHER PUBLICATIONS

Product Literature for Jaw Crusher BB-200, Retsch GmbH, Haan, Germany, https://www.retsch.com/products/milling/jaw-crusher/bb-200/function-features/.
Product Literature for Synthetron reactor technology and chemical reactor systems, KinetiChem, Inc., Camarillo, California, http://kinetichem.com/.

(Continued)

*Primary Examiner* — Cephia D Toomer
(74) *Attorney, Agent, or Firm* — McCarter & English, LLP

(57) ABSTRACT

A method of processing raw coal using activation agents (e.g., solvents and extractants) in a high shear reactor, which creates high shearing forces to break apart the coal and selectively extract and remove contaminants such as ash, sulfur, and other heavy metal impurities resulting in clean, high caloric-value coal.

18 Claims, 4 Drawing Sheets

(56) References Cited

OTHER PUBLICATIONS

Product Literature for Ultra Centrifugal Mill ZM-200, Retsch GmbH, Haan, Germany, https://www.retsch.com/products/milling/rotor-mills/zm-200/function-features/.
Radovic, et al., "Energy and Fuels in Society: Analysis of Bills and Media Reports", McGraw-Hill, 1997. Indiana Center for Coal Technology Research, Chapter 7 (pp. 113-136).
U.S. Energy Information Administration, Annual Energy Outlook 2018 with Projections to 2050, Feb. 6, 2018, pp. 1-74.
PCT International Search Report and Written Opinion dated Feb. 14, 2020 for PCT Application No. PCT/US2019/064245.
U.S. Appl. No. 62/775,617, filed Dec. 5, 2018.
PCT/US2019/064245, Dec. 3, 2019, WO 2020/117810.

* cited by examiner

PROCESS FOR PRODUCING CLEAN COAL USING CHEMICAL PRE-TREATMENT AND HIGH SHEAR REACTOR

CROSS-REFERENCE TO RELATED APPLICATION

The present application is a 35 U.S.C. § 371 National Stage filing of International Application No. PCT/US2019/064245, filed on Dec. 3, 2019, which application claims priority benefit to a U.S. provisional patent application entitled "A Process for Producing Clean Coal Using Chemical Pre-Treatment and High Shear Reactor," which was filed on Dec. 5, 2018, and assigned Ser. No. 62/775,617. The content of the foregoing PCT application and provisional patent application is incorporated herein by reference.

FIELD OF THE DISCLOSURE

The present disclosure relates to a method of treatment of raw coal to remove moisture, ash and other impurities to create a cleaner form of coal and, optionally, liquefaction of the cleaned coal product to produce other hydrocarbon compounds.

BACKGROUND OF THE DISCLOSURE

Increase in global energy consumption imposes an immediate increase in energy demand A new or alternative and sustainable form of fuel/energy is required to meet the ever-growing energy demand. Currently, the energy infrastructure relies heavily on oil and natural gas, which is being slowly depleted, and will require an alternative form of fuel for sustainability. [U.S. Energy Information Administration, Annual Energy Outlook, 2018]. Coal, having a highly abundant reserve, is a form of fuel that can be converted into a liquid fuel. However, the application of coal is limited due to its harmful environmental impacts as a result of burning (e.g., sulfur emission and ash residue), as well as high processing, emission controls, and mitigation and conversion costs. Many countries are enforcing an even more stringent emission protocol that calls for the reduction of sulfur and ash emissions to a non-hazardous level. This would require commercial processes to spend additional capital to develop a new process or upgrade an existing process to ensure a tighter control on hazardous emissions.

When coal is burned directly, such as at a power plant, a substantial amount of ash residue is generated. In some instances, for lignite coal, roughly 19% of the coal burned is ash content, which has negative heating value. This ash output varies depending on the rank of the coal. The disposal of such ash has become an enormous economic and environmental problem. The accumulation of ash residue in the ash pit is also a severe environmental problem. For example, excessive rainwater can carry the contents of the ash and transfer those contents into the ground. The contents may percolate into ground water and neighboring water systems thereby endangering the water quality of the drinking water and environment. Federal and State regulatory authorities require coal-fired power plants to prepare a decisive plan to mediate and/or dispose of such hazardous accumulation, such plans can incur billions of dollars in costs.

As briefly mentioned, coal is ranked based on the degree of coalification or metamorphism. There are four main types of coal, ranked from lowest to highest based on age of metamorphism (See Table 1), the ranks are as follows: lignite, sub-bituminous, bituminous, and anthracite. [Radovic, Ljubisa R. and Schobert, Harold H., "Energy and Fuels in Society: Analysis of Bills and Media Reports", McGraw-Hill, 1997. Indiana Center for Coal Technology Research, http://www.purdue.edu/dp/energy/CCTR/.]

TABLE 1

Age of formation and carbon content of different ranks of coal

| Coal Rank | Approximate Age (years) | Approximate Carbon Content (%) |
|---|---|---|
| Lignites | 60,000,000 | 65-72 |
| Subbituminous Coals | 100,000,000 | 72-76 |
| Bituminous Coals | 300,000,000 | 76-90 |
| Anthracites | 350,000,000 | 90-98 |

Lignite coal is a soft coal, usually black or brown, conventionally used for industrial heating. It has low amounts of fixed carbon (25% to 35%) and more volatile matter (>48%) and high moisture content (usually between 30% to 60% moisture, but can be as high as 73% by weight for some regional sources) and therefore has a low caloric (heating) value. The next rank is the sub-bituminous coal which has a slightly higher fixed carbon of 35% to 45% with 10% to 45% volatile matter, and lower moisture content (10% to 45%) compared to the lignite. This rank of coal also has a lower sulfur content (~1%) in comparison to the lignite coal (<2% sulfur). Bituminous is the next rank higher than the sub-bituminous coal with 45% but up to 80% fixed carbon content, only about 14% to 32% volatile matter, with the balance being moisture (2% to 15%), air, hydrogen, sulfur and other impurities. Of note, the bituminous coal is named as such because it contains higher amounts of "bitumen", which is a low-grade tarry substance, and is usually divided into two classes: "Thermal" for energy generation and "Metallurgical" for steel making Lastly, the highest ranked coal is the anthracite coal. It has the highest carbon content (between 85% to 98%) compared to the lower ranks, and only 1% to 14% volatile matter, which also makes it the most expensive coal and constitutes about 1% of the world's coal reserve. The anthracite coal has the lowest moisture and oxygen/volatile matter content of all the coal. Lower oxygenate volatile matter content also makes it hard to ignite, but when ignited, it burns the longest (highest fixed carbon). Details of the different characteristic properties of the coals are presented herein in Table 2. [Radovic et al.; Indiana Center for Coal Technology Research]. Different coal ranks will have varying amount and types of sulfur impurities and ash. The quantity and variability of sulfur content in coal makes it difficult to achieve commercial and emission standards.

TABLE 2

Characteristics and Properties of Coal by Ranks

| Coal Properties | Lignite | Sub-bituminous | Bituminous | Anthracite |
|---|---|---|---|---|
| Heat Content (Btu/lb)[a] | 4,000-8,000 | 8,500-13,000 | 11,000-15,000 | 13,000-15,000 |
| Moisture | 30-60% | 10-45% | 2-15% | <5% |

TABLE 2-continued

| Characteristics and Properties of Coal by Ranks | | | | |
|---|---|---|---|---|
| Coal Properties | Lignite | Sub-bituminous | Bituminous | Anthracite |
| Volatile Matter[b] | >48% | 10-45% | 14-32% | 1-14% |
| Ash | 10-50% | <=10% | 3-12% | 10-20% |
| Fixed Carbon | 25-35% | 35-45% | 45-85% | 85-98% |
| Sulfur (all forms) | 0.4-1.0% | <2% | 0.7-4.0% | 0.6-0.8% |

[a]Ash-free, moisture containing basis;
[b]dry-ash-free basis

The presence of sulfur will cause carbon deposits on the process catalysts (commonly referred to as coke), which will shorten the lifespan of the catalyst, thereby incurring high capital and operating costs. Moreover, the burning of sulfur-containing fuel releases the sulfur dioxide into the atmosphere, which forms acid rain and endangers the aquatic life and environment.

Sulfur may present itself in various forms in coal such as organic sulfur, inorganic sulfur (e.g., pyrite ($FeS_2$)), and as ferrous sulfate ($FeSO_4.7H_2O$). Nonetheless, the two main forms of sulfur measured in coal are discussed herein separately as inorganic and organic, and each requires a different process technology for removal. Due to the limitations of current coal desulfurization and de-ashing technology, the removal of impurities is limited to the surface or near-surface of the coal particles and not from the deeper core of a coal particle. These present methods limit the overall effectiveness of the process and require additional steps to achieve similar compliant coal. In one example, performing a standard oxidative desulfurization on Indian coal using hydrogen peroxide and acetic acid removes about 24% to 37% of sulfur for 1 to 4 hours of processing. [Saikia, 2013].

Based on the foregoing, a need exists for efficiently and effectively removing impurities from coal. These and other inefficiencies and opportunities for improvement are addressed and/or overcome by the assemblies, systems and methods of the present disclosure.

SUMMARY OF THE DISCLOSURE

The present disclosure relates to a method of raw coal treatment to remove moisture, ash and other impurities (e.g., sulfur and heavy metals) to create a cleaner form of coal. The clean coal may be converted into a liquid fuel for use in conventional equipment. More particularly, the present disclosure relates to a method of processing raw coal using activation agents (e.g., solvents and extractants) in a thin-film or high shear reactor. The disclosed reactor herein referred to as a "high shear reactor" (e.g., spinning disk, high shear, or other and/or including hydrodynamic cavitation reactor) produces forces to break apart the coal, and improves extractant contact allowing rapid extraction and removal of contaminants, such as ash producing, sulfur containing, and heavy metal impurities, resulting in clean, high caloric-value coal.

The present disclosure provides a treatment regimen for raw coal by first reducing the particle size of the coal to a fine powder of near dust-like consistency, then treating those fine particles by solvating the coal to create a coal suspension or slurry, and mixing the coal suspension or slurry with activation agents, such as an acid, base, and/or an oxidant in a high shear reactor to extract contaminants (e.g., sulfur and heavy metals), thereby producing a "clean" (i.e., low-impurity) coal product with high caloric value. The high shear reactor exerts an extremely high shearing force on the suspended coal particles, which further breaks apart the fine coal particles and allows the activating agents to swell and attack the further exfoliated coal particles exposing the impurities for chemical extraction.

In addition, high shearing forces break apart coal structure, and high shear displacement rate (SDR) reduces boundary layer diffusion barriers, allowing for greater contacting of clean solvent to wash away impurities, or bring chemical reactants in intimate contact to dissolve, react and solubilize/remove those impurities from the coal particle. The ability to simultaneously penetrate the coal matrix and percolate its pores and channels, through the use of the high shear reactor as disclosed herein, provides a significant advantage over existing desulfurization technologies. Specifically, the combination of oxidative desulfurization in a high shear reactor with liquid-liquid extraction, provides a process that is highly effective in reducing the sulfur content in coal as well as the removal of other unwanted impurities.

The disclosed process provides the opportunity to remove a majority of the impurities at a treatment facility. The extracted and sequestered impurities may be further processed to remove materials. For example, extracted and sequestered impurities may be further processed to remove valuable materials, which may provide additional revenue. The removed/recovered materials may include precious and semi-precious metals. The disclosed materials may include, but are not limited to, platinum, vanadium, palladium, lanthanides, actinides, among others.

As stated, oxidative desulfurization is a promising and effective treatment for the removal of inorganic and organic sulfur compounds from various forms of coal. This process introduces a mixture of an oxidant (e.g., hydrogen peroxide, performic acid, peracetic acid) and a weak acid or base (e.g., formic acid, acetic acid, sodium hydroxide) to oxidize the sulfur containing compounds into a sulfate or sulfur oxides and solubilize the oxides into a polar solvent.

Cavitation forces as a means to break up coal particles for assistance in the liquefaction process are disclosed herein. As further stated, coal treatment and purification may be greatly enhanced with the use of a high shear reactor (e.g., a spinning disk reactor or more specifically and alternately a spinning disk cavitation reactor). In this process, the mixture of pulverized fine coal slurry, which includes coal, oxidant, and acid or base, is recycled through a high shear reactor with a spinning disk. The rotational speed of the spinning disk is at least partially dependent on the coal slurry properties. Disk rotational speed affects several reaction parameters. First and foremost, the shear and mixing caused by the rotor maintains the slurry in suspension. Additionally, the shear of the spinning disk generates additional heat to drive the reaction, and the high shear mixing increases the reaction rates to conditions not found in conventional fixed bed or fluidized bed reactors. When considering the use of a cavitation style rotor, described below, the speed controls the inducement of high pressure zones and reaction conditions that are otherwise very difficult and costly to achieve in conventional large vessels for fluidized coal liquefaction. The forces caused by the rotor speed are also key to exfoliation and delamination of the coal layers to achieve total exposure of the contaminants and for liquefaction.

In one example, the spinning disk may rotate between about 5,500 RPMs to about 20,000 RPMs. This may further define a range of about 5,500 RPMs to about 6,000 RPMs. Another range may be defined between about 16,000 RPMs to about 20,000 RPMs. However, additional ranges may be appreciated. Additional design parameters and adjustments in operating conditions may include, but are not limited to, (i) the rotor gap to the static surfaces, (ii) the feed temperature, (iii) the vessel operating temperature, (iv) the coal slurry percent solids, (v) solvent viscosity and density, (vi) coal particle size, (vii) rotor diameter which determines the actual linear speed of the rotor edge, and any combination thereof. In any case, the rotational speed of the spinning disk, as discussed herein, provides necessary mixing and generates additional heat, and exerts a high shearing force on the solid particles which causes them to collide and exfoliate, thereby allowing the chemicals to penetrate and oxidize the deep sulfur compounds that are typically inaccessible within the amorphous solid coal particle matrix.

In operation, as the slurry is introduced from the bottom of a reactor body, the spinning disk rotor shears the slurry into a thin film and spreads outwardly through a gap between the parallel, or near parallel, faces of the rotor and stator, and towards the exterior wall of the cylindrical reactor body. The disclosed gap width may define a range between about 50 μm to about 200 μm. As the slurry film reaches the wall of the reactor body, it moves upwardly between the inner cylindrical wall of the reactor and the spinning rotor edge, towards the top of the reactor body and is simultaneously sheared between the curved cylindrical outer walls of the rotor and slightly larger inner cylindrical walls of the reactor body, thereby creating a characteristic flow pattern called the Dean Flow. Of note, the gap between the rotor face and the reactor static chamber may be different than the gap size between the rotor outer edge cylindrical wall and the reactor chamber inner cylindrical wall. For example, the gap width between the surfaces of the rotor outer edge cylindrical wall and the reactor chamber inner cylindrical wall may define a range between about 20 μm to about 800 μm. This Dean Flow phenomenon describes a flow between curved channels, which may be defined by the curved walls of the reactor body and the cylindrical outer wall edge of the rotor, in which a differential in pressure and velocity causes the flow to form internal vortices from the concave wall to the center of the flow, which thereby generates a secondary flow and further enhances the mixing of the slurry. The high shear mixing and high intensity collision generated allows the oxidized sulfur compounds to break from the coal matrix and solubilize in a polar solvent, which are available for extraction. The disclosed is not achievable in a conventional agitated mixing reactor.

In addition to desulfurization, demineralization and de-ashing of coal is also critically important and may be achieved concurrently with desulfurization or in a similar subsequent or precursory process step. The presence of the non-carbonaceous atoms such as heavy metals, silica and alumina reduces the heating value of the coal and ultimately forms ash when burned. Therefore, demineralization and de-ashing of coal are critical steps that may also be achieved using methods similar to the oxidative desulfurization. Furthermore, de-ashing of silica and alumina may be accomplished through an alkali treatment, which may be further enhanced in the high shear reactor, in a similar fashion as stated above.

Any combination or permutation of embodiments is envisioned. Additional advantageous features, functions and applications of the disclosed systems, methods and assemblies of the present disclosure will be apparent from the description which follows, particularly when read in conjunction with the appended figures.

BRIEF DESCRIPTION OF DRAWINGS

Features and aspects of embodiments are described below with reference to the accompanying drawings, in which elements are not necessarily depicted to scale.

Exemplary embodiments of the present disclosure are further described with reference to the appended figures. It is to be noted that the various features, steps and combinations of features/steps described below and illustrated in the figures can be arranged and organized differently to result in embodiments which are still within the scope of the present disclosure.

Figure 1:
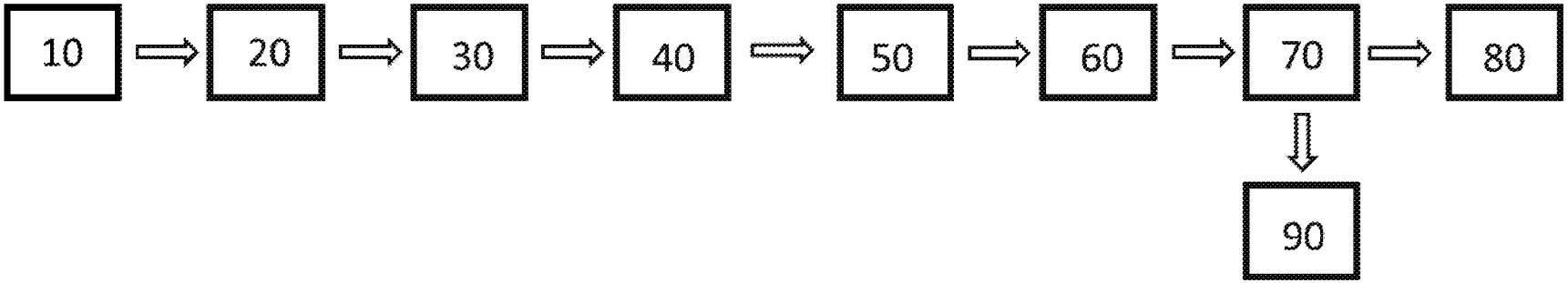
Figure 2A:
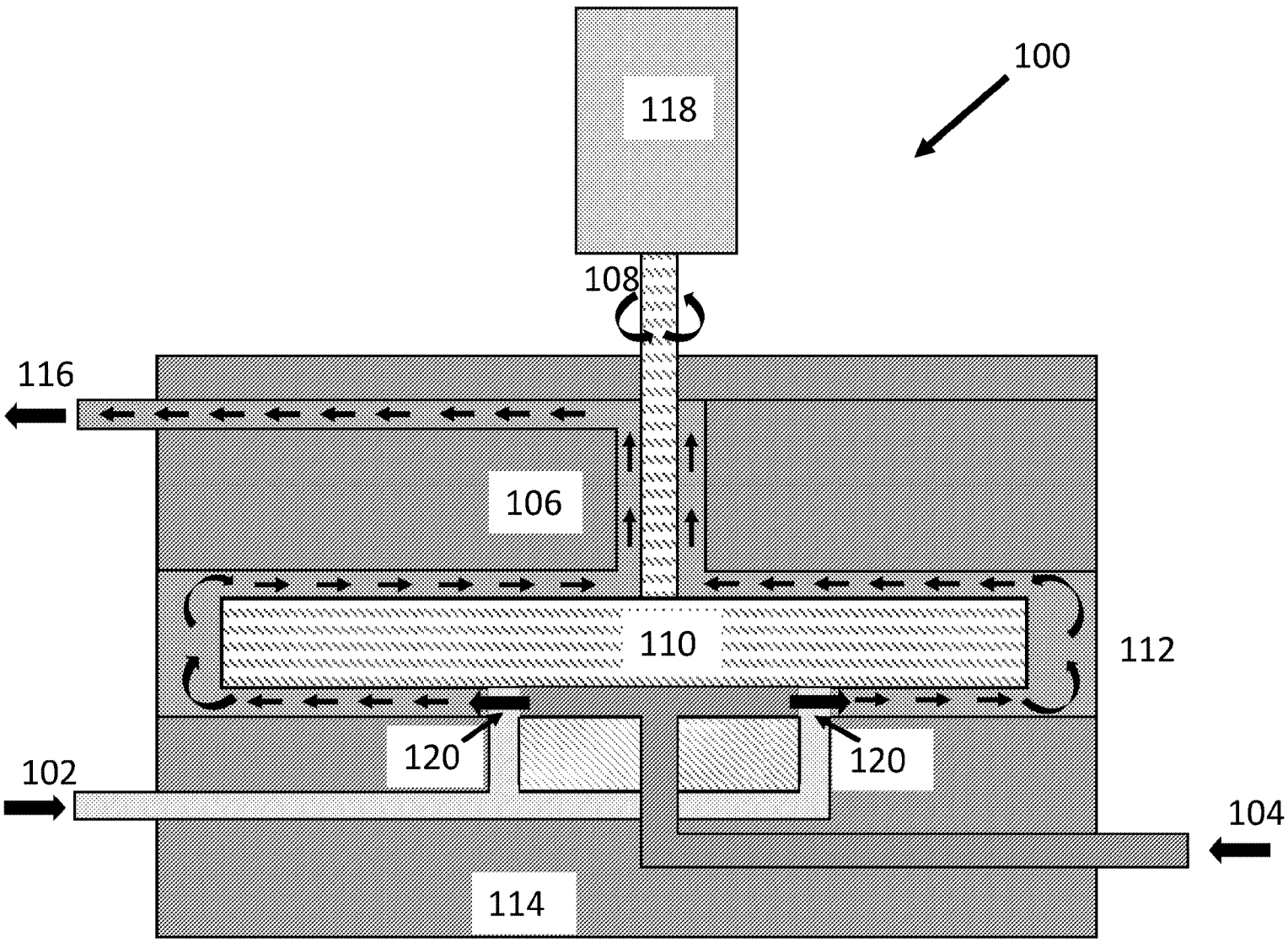
Figure 2B:
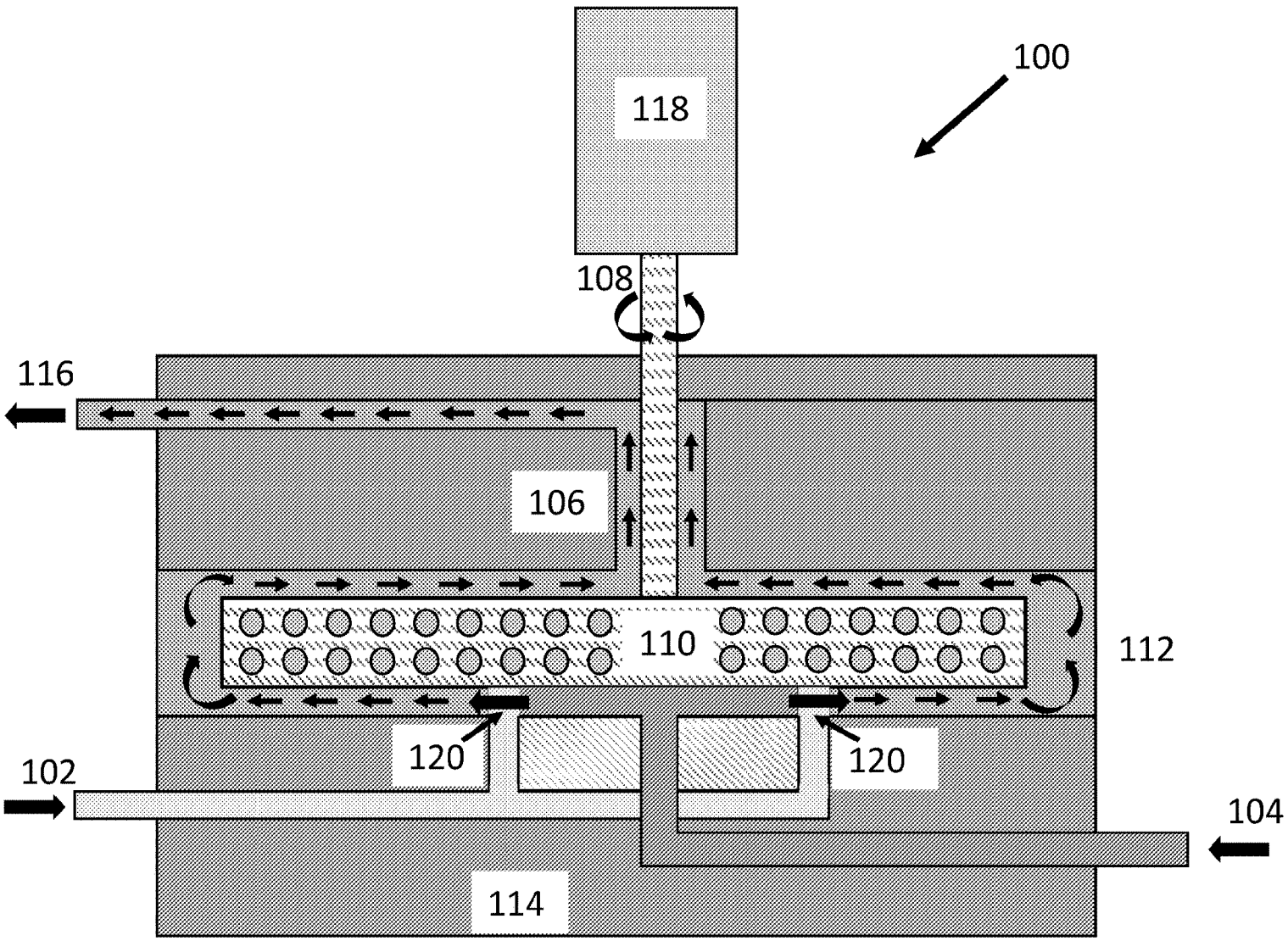
Figure 3:
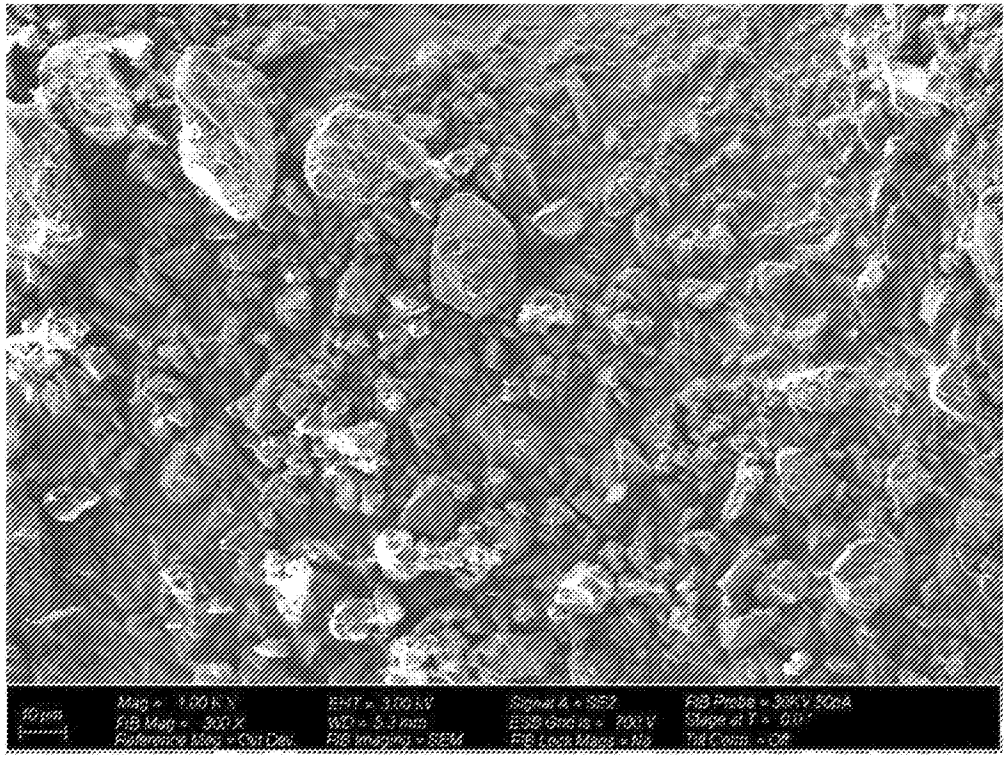

To assist those of ordinary skill in the art in making and using the disclosed assemblies, systems and methods, reference is made to the appended figures, wherein:

FIG. 1 schematically depicts a coal treatment process flow chart according to the present disclosure;

FIGS. 2A and 2B schematically depict a cross-section of a spinning disk reactor and cavitation rotor reactor according to the present disclosure; and FIG. 3 illustrates a magnified image of treated coal, captured by a Scanning Electron Microscope, according to the present disclosure.

DETAILED DESCRIPTION OF DISCLOSURE

The exemplary embodiments disclosed herein are illustrative of an advantageous method of raw coal treatment to remove moisture, ash and other impurities to create a cleaner form of coal.

Referring now to the drawings, like parts are marked throughout the specification and drawings with the same reference numerals, respectively. Drawing figures are not necessarily to scale and in certain views, parts may have been exaggerated for purposes of clarity.

FIGS. 1-2B depict an exemplary process of the treatment of coal. It should be understood, however, that FIGS. 1-2B are not to be interpreted as limiting, but merely as the basis for teaching one skilled in the art how to make and use the advantageous systems/methods (e.g., coal treatment) and/or alternative systems/methods of the present disclosure.

With specific reference to FIG. 1, the treatment process outlines an exemplary coal treatment process. Step 10 involves the procurement of raw coal. Next, at step 20, the raw coal is fed into a first grinder (e.g., Jaw Crusher BB-200 (Retsch® GmbH, Haan, Germany)) and the raw coal is ground to a particle size between about 1 mm and about 3 mm, referred to as "ground coal". Next, at step 30, the ground coal is fed into a secondary grinder (e.g., Ultra Centrifugal Mill ZM-200 (Retsch® GmbH, Haan, Germany)) and the ground coal is ground to a particle size between about 20 μm to about 80 μm, referred to as "fine coal". The Ultra Centrifugal Mill ZM-200 was outfitted with a 24-tooth rotor and an 80 μm distance sieve, however other configurations are expected. Next, at step 40, the fine coal particles are solvated in an activation solution to form a coal slurry. The liquids added are a solvent, an oxidant/activation agent and an extractant. In an exemplary embodiment, the activation agent may include, at least in part, a combination of de-ionized water, methanol, nitric acid, and hydrogen peroxide, however, additional compounds may be utilized. The coal slurry is then mixed (e.g., using a magnetic stir plate) at about 400 rpm for about 30 minutes.

Next, at step 50, the coal slurry is recycled through a high shear spinning disk reactor (e.g., Synthetron™ (KinetiChem, Inc., Camarillo, Calif.)) at a rotational speed of about 5,500 rpm to about 6,000 rpm (linear velocity 75-85 feet per second (fps) about 30 minutes). In other embodiments, shear speeds may approach much higher linear velocities (<150 fps) allowing contacting to occur more quickly and aggressively. In some embodiments, the disclosed high shear spinning disk may not include a cavitation inducing rotor or stator and other rotational speeds of the rotor based on fluid conditions and reactions to be performed.

The high shear spinning disk exerts shearing forces sufficient to promote collision, rotational and translational diffusivity of the solid particles, reducing boundary layer restrictions and improving contacting of solvents. This activity facilitates the exfoliation of the outer layers of the coal, further activates the coal particles and enables the chemicals to react and extract the impurities. For example, by allowing the coal particles to collide and break apart, the nitric acid penetrates the pores and channels of the coal particles causing them to swell, expand, soften, and physically weaken. As the coal particles swell and break apart, the organic and inorganic sulfur compounds are exposed (e.g., broken S—C bonds) and susceptible to an oxidation attack by a polar solvent (e.g., hydrogen peroxide and/or performic acid). The oxidized sulfur compounds break apart from the coal matrix and are solubilized in an aqueous polar phase. The less strongly bound metallic impurities, such as the transition metals, also undergo bond weakening and become susceptible for chemical extraction. In some instances, the temperature of the reactor may be increased to enhance the extraction of the impurities from the coal slurry.

Spinning disk reactor 100, as depicted in FIGS. 2A and 2B, includes liquid/slurry inlet A 102 and liquid/slurry inlet B 104, which mix at mixing points 120. Spinning disk reactor 100 further includes spinning disk 110 which is associated with rotor shaft 108 and motor 118. As stated above, spinning disk 110 may be rotationally driven at a predetermined, adjustable rotational speed. Positioned in close proximity to spinning disk 110 is spinning disk top plate 106 and spinning disk bottom plate 114, alternatively referred to as the "Stators". At least partially surrounding spinning disk 110 is contact/mixing chamber 112. Once the slurry is sufficiently mixed, the slurry is forced through liquid/slurry exit 116.

Next, at step 60, after about 30 minutes, a non-polar (or slightly polar) organic solvent (e.g., toluene, benzene) may be added into the coal slurry to promote phase separation in which the coal particles are selectively transferred from the aqueous phase into the non-polar organic phase leaving behind the impurities in the polar aqueous phase. As previously stated, the polar solvent solubilizes the oxidized sulfur compounds; meanwhile, the organic non-polar solvent (e.g., benzene, toluene, or similar) solubilizes the coal thus creating a separation between the extract (e.g., oxidized sulfur) and the raffinate (e.g., coal/hydrocarbon liquid). Due to the immiscibility of the two liquid solvents, the solvents will form a partition effect when left to settle in a container. Specifically, one layer containing the raffinate of the coal/hydrocarbon liquid and another layer containing the oxidized sulfur. Recycling of the suspended coal slurry may be advantageous for various reasons. Specifically, by recycling any of the suspended coal slurry, which may be contained in the organic layer of the settling vessel, back through the high shear reactor, the suspended coal particles will continue to shear and collide thereby progressively exposing more of the sulfur compounds for extraction. Additional forms of recycling may be utilized, for example, centrifugation. Additionally, the high shear reactor will facilitate the mixing of the polar and non-polar organic solvents, which further enhances the solubility and transfer of each component within the respective solvent.

Further, the oxidative desulfurization reaction proceeds with the addition of inputs to favor the formation of performic acid (HCO3H) directly within the high shear reactor (or by premixing and preparation before introducing it as performic acid) by reacting hydrogen peroxide with formic acid. The performic acid then reacts with an organic sulfur compounds of the coal through an electrophilic addition which oxidizes to sulfoxide, sulfonic acid, and sulfones. The oxidized sulfur compound is solubilized in the polar solvent and extracted from the coal matrix.

Following the desulfurization step, an alkali treatment with sodium hydroxide (NaOH) may facilitate the ash removal from the oxidized coal products. By introducing the sodium hydroxide into the oxidized coal slurry, the sodium hydroxide dissolves the alumina and silica to form soluble sodium silicate and sodium aluminate and further forms sodium aluminosilicate to be extracted.

In another exemplary embodiment, a cavitation rotor may be substituted for the standard smooth-faced rotor in the disclosed high shear spinning disk reactor to produce more aggressive reaction conditions. Contrary to the smooth surfaces of the spinning disk reactor rotor, the cavitation rotor includes small cavities (e.g., holes) drilled in predetermined locations (e.g., the bottom face or the cylindrical outer side face of the rotor) which creates the cavitation effect. When the liquid or slurry is in contact with the cavitation rotor, which may be spinning at high speeds, the passing of the liquid across the rotor's surface, specifically the cavities, produces microscopic bubbles. The microscopic bubbles are generated by the instantaneous low localized fluid pressure at the moving rotor surface. The bubbles continue to form and collapse due to the return of the high pressure in their vicinity. Upon collapse, the liquid rushes into the cavity from all directions and ends at a singular point. At this singular point, the gaseous compounds that were inside the bubble experience compression and condensation until the collapse finally stops, at which point the pressure can increase substantially (e.g., by hundreds to thousands of times of the apparent pressure in the reactor chamber). The spinning disk cavitation reactor utilizes the high instantaneous and localized energy dissipated by the generation and collapse of the bubbles to initiate chemical reactions that otherwise would require substantially higher temperature and pressure within the uniform bulk volume of a typical fluidized bed or fixed bed reactor. Various parameters of the bubbles (e.g., size, direction, speed) may be controlled by rotational speed of the cavitation rotor, solvent choice, solvent flow rate, spin rate, temperature, pressure and/or by physical dimensions of the cavitation rotor (e.g., diameter; height of the cylindrical outer diameter wall of the rotor; placement of the cavitator holes into the faces of the rotor; dimensions of the actual cavitator holes formed into the cavitation rotor which includes cones, cylinders, orthogonal, vertical slits, diagonal slits; as well as exit ports at the base or sides of the cavitator holes to other flow zones in the chamber; among other parameters).

With respect to the desulfurization of coal, by harnessing the kinetic energy produced during the collapse of a bubble, the energy may be transferred into flow turbulence, pressure, and temperature, and may be directed to a localized point of reaction (e.g., the rigid matrixes of the coal particles). The cavitation bubbles, when imploded, focalize extremely high pressure and temperature at its point of collapse, which enables (i) the mechanical breakdown and breakthrough of the tightly bound coal matrix, thereby exposing the internal lattice; and (ii) favored chemical reactions for the coal liquefaction, desulfurization, and or de-ashing, include oxidative desulfurization, chemical reduction, or may also include catalytic hydrogenation (under such known processes as hydro-desulfurization), or coal hydro-liquefaction at these intensified reaction conditions. Upon collapse and/or exfoliation of the coal matrix, the internal structures of the coal particles are exposed which enables the extractants to penetrate deeper, react, and extract the impurities. Additionally, the cavitation effect, through its high shearing and implosive forces, may convert the coal particles into a fluidic state, by breaking the coal matrix. The ability to generate high pressure and temperature in a localized regime provides the opportunity to produce challenging chemical reactions, such as commonly understood coal hydrogenation and coal liquefaction, and processes in a much intensified and controlled environment, which may substantially lower the operating and capital costs of these favorable coal conversion processes.

Next, at step 70, the two phases (e.g., aqueous polar and organic non-polar) are separated by gravimetric means. The organic phase, which contains the coal solvated in toluene, may be washed with nitric acid to further remove any impurities. The organic phase may be recycled to further reduce the impurity concentration. The extracts (e.g., contaminants and ash) may be collected at position 90.

Lastly, at step 80, the liquefied clean coal product and any remaining final coal slurry, which is suspended in the polar solvent and the coal liquefaction product, are separated, and any remaining clean fine coal product is dried by evaporating the polar solvent. The polar solvent may be condensed and recycled through the aforementioned extraction and separation step. In some instances, the coal liquefaction product is less volatile than the polar solvent (e.g., toluene). The outcome is a processed clean coal containing a minimal amount of impurities. The processed clean coal may be in the form of a liquid, a dried fine solid, or a suspended slurry.

In an exemplary embodiment, the disclosed processed clean coal may produce a liquid coal-sourced product for use, in whole or in part, in power generation equipment (e.g., boilers). In another exemplary embodiment, the disclosed processed clean coal may produce a coal-sourced clean and customizable formulation for use, in whole or in part, in DC fuel cells (e.g., electric vehicle charging, grid power, localized power generators, emergency generators). In another embodiment, the disclosed processed clean coal may be used, in whole or in part, as a fuel source in an engine (e.g., internal combustion engines, turbine engines). In yet another embodiment, the disclosed processed clean coal may be used, in whole or in part, as an industrial chemical, as a solvent and/or as a cleaning agent. However, the applications for the disclosed processed clean coal are not limited to the exemplary embodiments disclosed herein.

In one example, raw coal samples of ranked bituminous and anthracite, obtained from Pennsylvania and Virginia mines, were sent for elemental analysis prior to pretreatment. The coal samples exhibited sulfur content ranging from 5600 to 7800 ppm (e.g., 0.56% to 0.78% by weight) for anthracite and bituminous coal, respectively. Additional impurities included nitrogen, oxygen, alkali metal, silica and noble metals such as palladium and platinum. The coal samples were treated using the above-mentioned treatment process, FIG. 3 illustrates the result of the treatment process using a scanning electron microscope.

Although the present disclosure has been described with reference to exemplary implementations, the present disclosure is not limited by or to such exemplary implementations. Rather, various modifications, refinements and/or alternative implementations may be adopted without departing from the spirit or scope of the present disclosure.

The invention claimed is:

1. A method for producing clean coal comprising:

grinding coal particles into a dust-like consistency, having a diameter between about 20 μm and 80 μm;

mixing the ground coal particles with at least one extractant, at least one oxidant or other activation agent and an aqueous polar solvent to produce a coal slurry;

introducing the coal slurry into a thin-film shear reactor, wherein the thin-film shear reactor promotes contact of the ground coal particles and the at least one oxidant or other activation agent by exerting shearing forces sufficient to promote collision, rotational and translational diffusivity of the ground coal particles, reducing boundary layer restrictions and improving contact within the coal slurry, thereby solubilizing at least one impurity in the aqueous polar solvent; and introducing a non-polar organic solvent to separate the ground coal particles and the at least one impurity by extracting the ground coal particles from the aqueous polar solvent that contains the at least one impurity into the non-polar organic solvent, wherein the at least one oxidant or other activation agent and the non-polar organic solvent are mixed with the ground coal particles as liquids; and wherein extraction of the ground coal particles from the at least one impurity yields processed clean coal.

2. The method according to claim 1, wherein the thin-film shear reactor is selected from a group consisting of a spinning disk reactor, a cavitation reactor, and a combination thereof.

3. The method according to claim 1, wherein the at least one oxidant or other activation agent is selected from a group consisting of performic acid, nitric acid, hydrogen peroxide, sodium hydroxide, peracetic acid, formic acid, acetic acid, and any combination thereof.

4. The method according to claim 1, wherein the thin-film shear reactor operates in a continuous or semi-continuous manner.

5. The method according to claim 1, wherein the thin-film shear reactor is temperature controlled.

6. The method according to claim 1, wherein the thin-film shear reactor operates at a rotational speed between 5,000 RPMs and 20,000 RPMs.

7. The method according to claim 1, wherein the thin-film shear reactor operates at a linear velocity of 50-180 fps.

8. The method according to claim 1, wherein the thin-film shear reactor further comprises surface-to-surface gaps, having a stator gap spacing between 50 μm and 200 μm.

9. The method according to claim 1, wherein the thin-film shear reactor further comprises surface-to-surface gaps having a cylinder-in-cylinder wall stator gap spacing between 20 μm and 800 μm.

10. The method according to claim 1, wherein the extracted ground coal particles within the non-polar organic solvent is separated from the non-polar organic solvent, washed and dried.

11. The method according to claim 1, wherein further processing of the aqueous polar solvent after extraction of the ground coal particles therefrom extracts at least one material from the aqueous polar solvent.

12. The method according to claim 11, wherein the at least one material comprises at least one precious or semi-precious metal.

13. The method according to claim 11, wherein the at least one material comprises at least one of platinum, vanadium, palladium, a lanthanide and an actinide.

14. The method according to claim 1, wherein the processed clean coal is in the form of a liquid, a dried fine solid, or a suspended slurry.

15. The method according to claim 14, further comprising using the processed clean coal as an energy source.

16. The method according to claim 1, further comprising using the processed clean coal in an application selected from the group consisting of boilers, generators, fuel cells, engines, solvents, cleaning agents, and any combination thereof.

17. The method according to claim 1, wherein the thin-film shear reactor is a spinning disk cavitation reactor.

18. The method according to claim 1, wherein the thin-film high shear reactor includes a cavitation rotor that defines cavities on a face thereof.

* * * * *